US006565340B2

(12) United States Patent
Fujita et al.

(10) Patent No.: US 6,565,340 B2
(45) Date of Patent: May 20, 2003

(54) COMPRESSOR HAVING A SEAL MEMBER FOR SUPPORTING A SHAFT DURING ASSEMBLY

(75) Inventors: Katsuhiro Fujita, Nishi-kasugai-gun (JP); Yasuhiro Wada, Nishi-kasugai-gun (JP); Shigeki Miura, Nishi-kasugai-gun (JP); Tetsuzou Ukai, Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/984,143

(22) Filed: Oct. 29, 2001

(65) Prior Publication Data

US 2002/0057977 A1 May 16, 2002

(30) Foreign Application Priority Data

Nov. 16, 2000 (JP) ..... 2000-349550

(51) Int. Cl.[7] ..... F04C 18/04; F04C 27/00
(52) U.S. Cl. ..... 418/55.4; 418/55.1; 418/104
(58) Field of Search ..... 418/55.1, 55.4, 418/104; 29/888.022

(56) References Cited

U.S. PATENT DOCUMENTS 4,673,340 A * 6/1987 Mabe et al. ..... 418/55.1
4,744,733 A 5/1988 Terauchi et al. ..... 417/310
4,940,342 A * 7/1990 Miyazawa et al. ..... 418/55.4
6,132,179 A 10/2000 Higashiyama ..... 417/310
6,439,775 B1 * 8/2002 Ito ..... 418/55.1

FOREIGN PATENT DOCUMENTS

| | | |
|---|---|---|
| EP | 077212 | 4/1983 |
| EP | 0889241 | 7/1999 |
| JP | 56156491 | 7/1980 |
| JP | 09112452 | 2/1997 |
| JP | 3025154 | 1/2000 |

* cited by examiner

*Primary Examiner*—John J. Vrablik
(74) *Attorney, Agent, or Firm*—Oblon, Spivak, McClelland, Maier & Neustadt, P.C.

(57) ABSTRACT

A compressor assembled under desirable working conditions at a low cost is disclosed. In the compressor, the first rolling bearing for permitting axial movement of the shaft is inserted into the first housing from the side where the compression mechanism is to be provided, and the second rolling bearing for restricting axial movement of the shaft is inserted into the first housing from the other side where the driving source is to be provided. The shaft is inserted into the first housing from the side where the compression mechanism is to be provided. A seal member is further provided between the rolling bearings for sealing an area between the insertion hole and the shaft, wherein the seal member is inserted into the insertion hole of the first housing from the side where the compression mechanism is to be provided before the shaft is inserted into the insertion hole.

2 Claims, 2 Drawing Sheets

COMPRESSOR HAVING A SEAL MEMBER FOR SUPPORTING A SHAFT DURING ASSEMBLY

BACKGROUND OF THE INVENTION

1. Field of the Invention

The present invention relates to an open-type compressor which is built into an air conditioner, refrigerating machine, or the like.

2. Description of the Related Art

Conventionally, air conditioners, refrigerating machines, and the like employ a compressor such as a scroll compressor.

Generally, in scroll compressors, a fixed scroll member which has a base plate and a spiral portion, and a revolving scroll member which also has a base plate and a spiral portion face each other in a manner such that their spiral portions are engaged with each other with a phase difference of 180°, and compression chambers are formed between the scroll members. According to the rotation of the shaft, the revolving scroll member revolves around the axis of the fixed scroll member, so that the capacities of the compression chambers gradually reduce while the positions of the compression chambers gradually move from the peripheral side to the center side of the spiral portions, thereby compressing the relevant gas.

FIG. 2 shows a conventional open-type scroll compressor applied to an air conditioner which is built into a vehicle. In a closed housing H consisting of a front housing 4 and a rear housing 5, a scroll compression mechanism C is contained, and an electromagnetic clutch MC is provided at the outside of an end portion of the front housing 4. The scroll compression mechanism C and the electromagnetic clutch MC are directly coupled and joined with each other via a shaft 6, an end of which protrudes from the front housing 4.

The shaft 6 is rotatably supported by a main bearing 7*a* and a sub bearing 7*b*, where these bearings are contained in the front housing 4. Here, the main bearing 7*a* is a needle bearing consisting of an outer ring and a plurality of roller-shaped needles, while the sub bearing 7*b* is a ball bearing consisting of a plurality of balls between outer and inner rings.

Between the main bearing 7*a* and the sub bearing 7*b*, a seal member 34 made of an elastic rubber material is provided, which is also contained in the front housing 4. Owing to the seal member 34, leakage of gas or lubricating oil inside the housing H can be prevented. Additionally, the motion of the seal member 34 in the axial direction of the front housing 4 is prohibited by a stopper 34*a*.

In the above-explained compressor, when power is transmitted from an external power source (not shown) via a belt to the electromagnetic clutch MC, the shaft 6 rotates and drives the scroll compression mechanism C, so that a refrigerant gas is introduced from a suction hole (not shown) into the closed housing H. This introduced gas is compressed by the scroll compression mechanism C and discharged through a discharge hole (not shown) to the outside of the housing H.

Below, the electromagnetic clutch MC will be explained. An end portion of the shaft 6 of the above-explained scroll compressor is inserted through an attachment hole 41*a* of an armature plate 41. The armature plate 41, which is a constituent of the electromagnetic clutch MC, is fastened by using a nut 42 which is screwed and fit onto the end portion of the shaft 4.

A rotor 43, which is also a constituent of the electromagnetic clutch MC, is rotatably attached to the front housing 4, and the rotor 43 rotates by receiving power which is transmitted from an external power source (not shown) via a V-belt (not shown). When a coil (not shown) contained in the rotor 43 of the electromagnetic clutch MC is excited (or energized) by receiving a supplied current, the armature plate 41 is attracted to the rotor 43, so that the rotational power of the rotor 43 is transmitted to the shaft 6.

As for a clearance δ between the rotor 43 and the armature plate 41 which are constituents of the electromagnetic clutch MC, if the clearance δ set at the time of assembly is too large, the rotor 43 and the armature plate 41 do not contact each other when the coil is excited, so that the shaft 6 cannot be driven. Conversely, if the clearance δ set at the time of assembly is too small, the armature plate 41 will always contact the rotor during rotation, so that an abnormal sound or abnormal abrasion due to heat (generated by continuous contact) may occur. Therefore, in the assembly, a specific clearance δ (approximately 0.1 to 0.3 mm) must be set between the rotor 43 and the armature plate 41. Accordingly, in this compressor, a shim 56 for adjusting the clearance is placed between the armature plate 41 and the inner ring of the sub bearing 7*b*.

Additionally, in the structure of this compressor, the outer ring of the sub bearing 7*b* contacts a step portion 4*b* formed in the front housing 4. That is, even if a load for forcing the shaft 6 back towards the inside of the housing H acts via the armature plate 41 after assembly, the movement of the outer ring of the sub bearing 7*b* and the front housing 4 is restricted, thereby preventing the clearance δ from being too small.

Furthermore, the inner ring of the sub bearing 7*b* contacts a stopper 6*b* at the compression mechanism side of the sub bearing 7*b*, where the stopper 6*b* is fit into a groove 6*c* which is formed on the shaft 6. Accordingly, even if a load for extracting the shaft 6 from the housing H acts via the armature plate 41 after assembly, the movement of the shaft 6 and the inner ring of the sub bearing 7*b* is restricted, thereby preventing the clearance δ from being too large.

In the scroll compressor having the above structure, in the first step of attaching the shaft 6 to the front housing 4, the main bearing 7*a* is pressed into the front housing 4, and the shaft 6 is made to fall into the front housing 4 which is positioned in a manner such that the side which will contact the rear housing 5 is set to be the top side. In the next step, the position (or orientation) of the front housing 4 is inverted, and the seal member 34 is fit around the shaft 6 and onto the step portion 4*a*, where the step portion 4*a* is formed in an inner-peripheral face of the front housing 4. The stopper 34*a* is then attached.

In the following step, the stopper 6*b* is attached to the shaft 6, and the sub bearing 7*b* is pressed into the inner-peripheral face of the front housing 4, and simultaneously, the sub bearing 7*b* is fit onto the step portion 4*b* which is formed in the inner-peripheral face of the front housing 4.

However, in the above-explained compressor, the main bearing 7*a* employs a needle bearing consisting of an outer ring and a plurality of roller-shaped needles. Therefore, when the front housing 4 is inverted after the insertion of the shaft 6 into the front housing 4, the shaft 6 may fall from the front housing 4 because the main bearing 7*a* has no capability of controlling the position of the shaft 6 in its axial direction. Accordingly, improved working conditions have been desired.

In addition, the stoppers 34*a* and 6*b* are positioned very deep in the inner-peripheral side of the front housing 4.

Therefore, various relevant parts are required, and thus the assembling process is complicated and difficult.

Also in the compressor, the stopper 6*b* is fit into the groove 6*c* which is formed on the shaft 6, so as to determine the clearance δ of the electromagnetic clutch MC. However, if the stopper 6*b* is not appropriately fit into the groove 6*c* (i.e., having play or the like), the clearance δ of the electromagnetic clutch MC is not fixed. In order to solve this problem, the stopper 6*b* and groove 6*c* must be very accurately processed.

In addition, during the checking or repair of the above compressor which has the stopper 6*b* on the shaft 6, when the shaft 6 is extracted from the front housing 4, a portion of the stopper 6*b* is caught by the seal member 34; thus, it is very difficult to exchange the current shaft for another.

SUMMARY OF THE INVENTION

In consideration of the above circumstances, an object of the present invention is to provide a compressor which can be assembled under desirable working conditions at a low cost.

Therefore, the present invention provides a compressor comprising:

a first housing;

a shaft having an end portion which protrudes from the first housing and which is rotated by a driving source;

a compression mechanism provided at the side of the other end portion of the shaft for compressing and discharging a gas which is absorbed into the compression mechanism due to the rotation of the shaft;

a second housing for containing the compression mechanism, the second housing being joined with the first housing; and first and second rolling bearings for rotatably supporting the shaft, wherein the first and second rolling bearings are positioned in an insertion hole which is formed in the first housing and into which the shaft is inserted, and wherein:

the first rolling bearing for permitting the movement of the shaft in the axial direction of the shaft is inserted into the first housing from the side where the compression mechanism is to be provided;

the second rolling bearing for restricting the movement of the shaft in the axial direction of the shaft is inserted into the first housing from the other side where the driving source is to be provided; and the shaft is inserted into the first housing from the side where the compression mechanism is to be provided, the compressor further comprising:

a seal member provided between the first and second rolling bearings for sealing an area between the insertion hole and the shaft, wherein the seal member is inserted into the insertion hole of the first housing from the side where the compression mechanism is to be provided before the shaft is inserted into the insertion hole.

According to the above compressor, the seal member is provided in advance before the shaft is inserted; thus, the inserted shaft can be supported by the elastic seal member. Therefore, even when the first housing after this process is inverted so as to insert and build other components (to be assembled) from the other side, it is possible to prevent the shaft (inserted into the insertion hole) from falling from the housing, thereby improving the working conditions.

Preferably, a protrusion is formed in a circumferential direction on an inner peripheral face of the insertion hole of the first housing; and the seal member is inserted into the insertion hole in a manner such that the seal member is positioned between the protrusion and the compression mechanism.

Accordingly, the position of the seal member in the first housing in the axial direction of the shaft is restricted by the protrusion; thus, a stopper or the like for holding the seal member is unnecessary, thereby improving the working conditions for assembly and reducing the number of parts and the costs.

It is possible that:

the second rolling bearing has inner and outer rings, and the position of the second rolling bearing with respect to the first housing in the axial direction of the shaft is determined by making the outer ring contact a side face of the protrusion; and the shaft has a step portion formed at a head portion of the shaft, and the position of the shaft with respect to the second rolling bearing in the axial direction of the shaft is determined by making the step portion contact the inner ring.

Accordingly, the positioning is performed in a manner such that the step portion of the shaft contacts the second rolling bearing, where the second rolling bearing contacts the protrusion so as to determine its position with respect to the first housing. Therefore, the position of the shaft with respect to the first housing can be reliably and accurately determined via the second bearing; thus, a stopper or the like for positioning the shaft is unnecessary, thereby improving the working conditions for assembly and reducing the number of parts. In addition, during checking or repair, the shaft can be easily extracted, thereby improving the working conditions.

Typically, the compressor is a scroll compressor.

DESCRIPTION OF THE PREFERRED EMBODIMENTS

Figure 1:
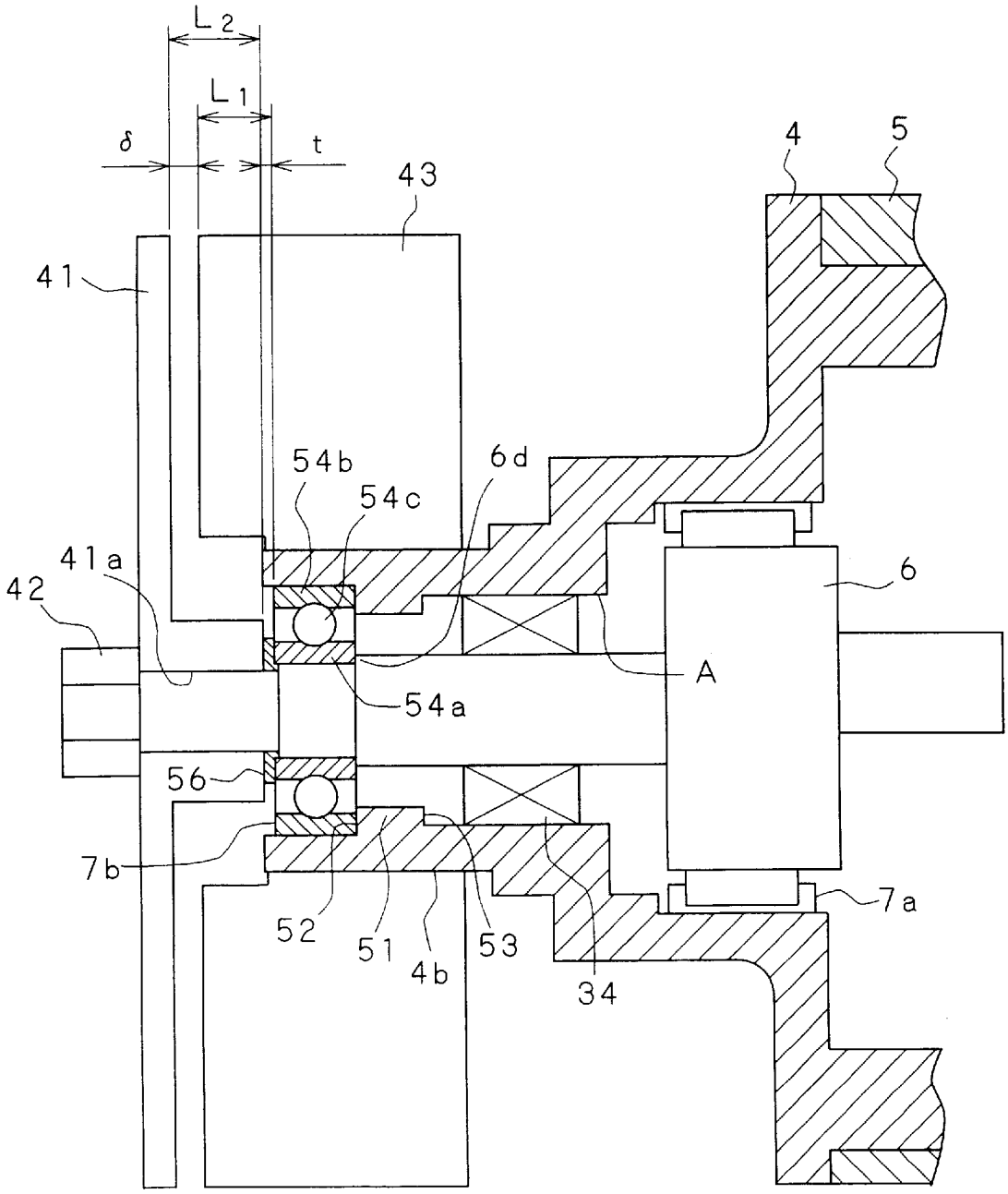
FIG. 1 is a cross-sectional view showing the structure of an embodiment of the scroll compressor according to the present invention.

Hereinafter, an embodiment of the compressor according to the present invention and a method of assembling the compressor will be explained in detail with reference to the drawings. In the drawings, parts identical to those present in the above-explained conventional example are given identical reference numerals, and explanations thereof will be omitted. In addition, no compression mechanism is shown in FIG. 1, so as to enlarge distinctive portions of the present invention, but a compression mechanism similar to that shown in FIG. 2 is employed in the present compressor.

Figure 2:
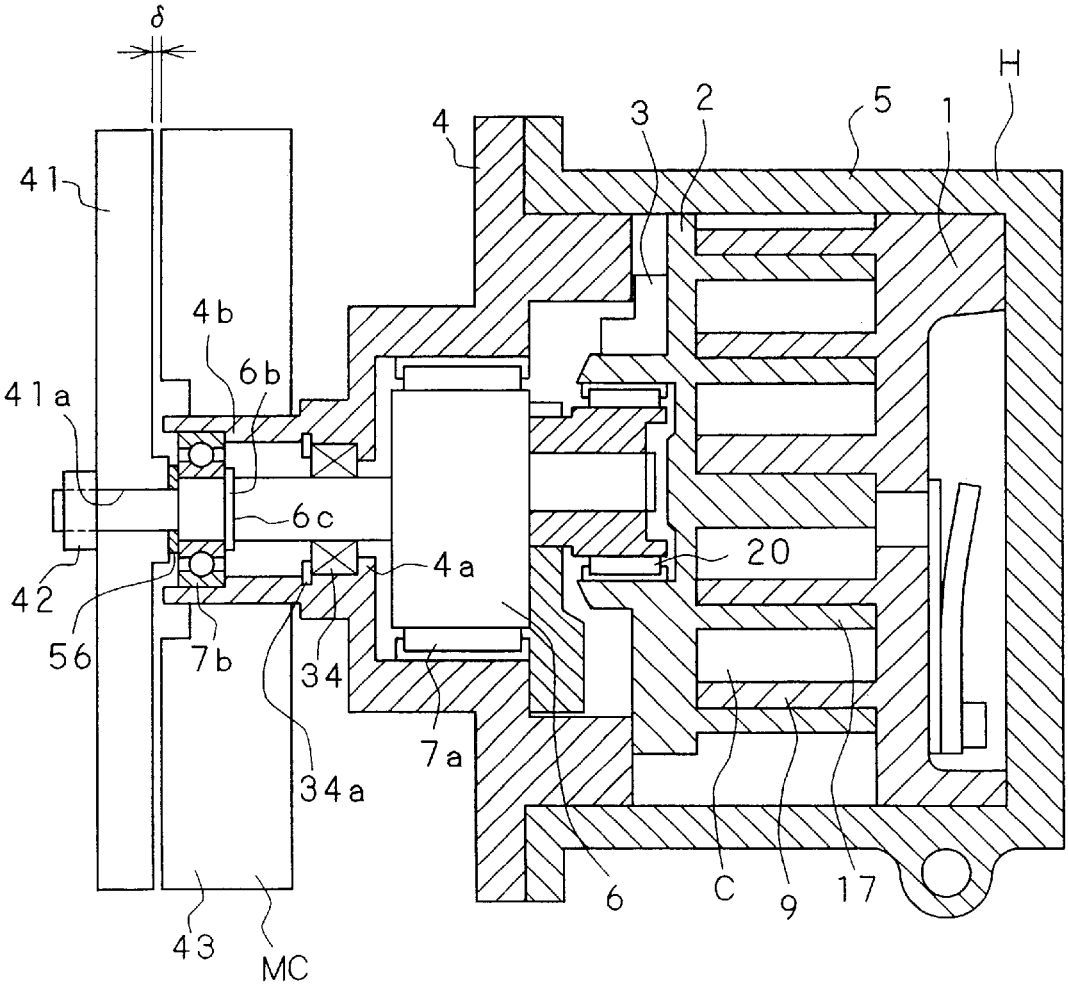
FIG. 2 PRIOR ART
FIG. 2 is a cross-sectional view showing the structure of a conventional scroll compressor.

As shown in FIG. 1, a front housing 4 (corresponding to the first housing of the present invention) as a constituent of the present scroll compressor (corresponding to the compressor of the present invention) has an insertion hole A into which a shaft 6 is inserted. A positioning protrusion 51 (corresponding to the protrusion of the present invention) is provided in the circumferential direction on an inner peripheral face of the insertion hole A. Along the axial direction, the positioning protrusion 51 has two step portions, one at each side: the one positioned at the front side is a step portion 52 for holding a sub bearing 7*b*, while the other positioned at the rear side is a step portion 53 for holding a lip seal 34 (corresponding to the seal member of the present invention).

The sub bearing 7*b*, which is inserted from the front side, contacts the step portion 52 so that the position of the sub bearing 7*b* is restricted. Conversely, when the lip seal 34, which is inserted from the rear side, is pushed towards the front side by a high-pressure gas, the lip seal 34 contacts the step portion 53, so that the position of the lip seal is restricted.

Additionally, the present scroll compressor employs two kinds of bearings for supporting the shaft 6: one is a main bearing 7*a* (corresponding to the first rolling bearing of the present invention) which employs a needle bearing, and the other is the sub bearing 7*b* (corresponding to the second rolling bearing of the present invention) which employs a ball bearing.

A shim 56 for adjusting a clearance δ for an electromagnetic clutch MC is placed between a side face of an inner ring 54*a* of the sub bearing 7*b* (which is placed at the head portion of the shaft 6) and an end face of an armature plate 41 of the electromagnetic clutch MC, and the armature plate 41 is pressed towards the inner ring 54*a* of the sub bearing 7*b* via the shim 56.

In addition, a positioning step portion 6*d* is formed at the top head side of the shaft 6. The inner ring 54*a* of the sub bearing 7*b*, onto which the armature plate 41 is pressed via the shim 56, is pressed towards the step portion 6*d*, thereby positioning the shaft 6 with respect to the sub bearing 7*b*.

Below, the process of assembling the front housing 4 side of the scroll compressor having the above-explained structure will be explained.

Step 1: The main bearing 7*a* (which employs a needle bearing) and the lip seal 34 are pressed into the insertion hole A of the front housing 4.

In this step, the side of the front housing 4, which is joined with a rear housing 5 (corresponding to the second housing of the present invention), is positioned upward.

Step 2: The shaft 6 is inserted into the insertion hole A of the front housing 4 from the upper side of the front housing 4.

In this step, a cap made of metal or the like is attached to the shaft 6 in advance. Accordingly, it is possible to prevent the lip seal 34 from being damaged by a screw portion at the head of the shaft 6 or the positioning step portion 6*d*, where such damage may occur when the shaft 6 is passed through the lip seal 34 which is attached to the front housing 4.

The above cap is detached after the shaft 6 is inserted into the front housing 4.

Step 3: The front housing 4, into which the shaft 6 is inserted, is inverted in a manner such that the other end of the insertion hole A is positioned upward.

Here, the shaft 6 is inserted into the lip seal 34 which is fit into the front housing 4 in advance; thus, the shaft 6 is reliably held by the lip seal 34 while the front housing 4 is inverted. Therefore, the shaft 6 does not fall during the inverting process.

Step 4: After the front housing 4 is positioned in a manner such that the other end of the insertion hole A is positioned upward as explained above, the sub bearing 7*b* is pressed into the front housing 4 from the other end. That is, the outer ring 54*b* of the sub bearing 7*b* is pressed into the insertion hole A of the front housing 4 while the shaft 6 is inserted into the inner ring 54*a* of the sub bearing 7*b*. In this step, the outer ring 54*b* is pressed until the outer ring 54*b* contacts the step portion 52.

Step 5: A rotor 43 of the electromagnetic clutch MC is attached to a boss portion 4*b* of the front housing 4, and a distance L1 between a side face of the inner ring 54*a* of the sub bearing 7*b* and a side face of the rotor 43 is measured. In addition, a distance L2 between the friction face of the armature plate 41 and an end face of the boss portion 4*b* is also measured, and the plate thickness of the shim 56 is determined. More specifically, a shim which satisfies the condition "$t=L1-L2+\delta$" is selected, and the shaft 6 is made to pass through this shim 56 so that the shim 56 contacts a side face of the inner ring 54*a* of the sub bearing 7*b*.

Step 6: The armature plate 41 of the electromagnetic clutch MC is arranged by inserting the shaft 6 into an attachment hole 41*a* of the armature plate 41. Accordingly, the shim 56 is placed between the relevant end face of the armature plate 41 and the inner ring 54*a* of the sub bearing 7*b* in a state of contact.

Step 7: A nut 42 is engaged with a screw section formed at the head of the shaft 6. Accordingly, the armature plate 41 and the inner ring 54*a* of the sub bearing 7*b*, between which the shim 56 is placed, are supported and fastened by the positioning step portion 6*d* of the shaft 6 and the nut 42. Therefore, the position of the positioning step portion 6*d* of the shaft 6 is determined with respect to the sub bearing 7*b*, where the sub bearing 7*b* contacts the step portion 52 (for holding the sub bearing) and the position of the sub bearing 7*b* with respect to the front housing 4 is determined.

According to the above steps 1 to 7, the front housing 4 side of the present scroll compressor is assembled.

As explained above, according to the present scroll compressor, the lip seal 34 is provided at one side of the positioning protrusion 51 which is formed in the insertion hole A, where the shaft 6 is inserted into the insertion hole A from this side. Therefore, after the shaft 6 is built into the front housing 4, the shaft 6 can be held by the lip seal 34, and under this condition, the components, such as the sub bearing 7*b*, are attached from the other side of the front housing 4 (which is opposite the side from which the shaft 6 is inserted). Accordingly, even when the front housing 4 is inverted, it is possible to prevent the shaft 6 (built into the insertion hole A) from falling from the front housing 4, thereby improving the working conditions of the assembly.

In addition, the positioning protrusion 51 is formed in the insertion hole A; thus, another part, such as a stopper, for holding the lip seal 34 is unnecessary, thereby reducing the number of parts and the cost.

Also in the above-explained structure, the sub bearing 7*b* contacts the positioning protrusion 51 so that the position of the sub bearing 7*b* with respect to the front housing 4 is determined, and the shaft 6 is positioned by making the positioning step portion 6*d* of the shaft 6 hold the sub bearing 7*b*. Therefore, the position of the shaft 6 with respect to the front housing 4 can be reliably and accurately determined via the sub bearing 7*b*.

Furthermore, during the checking or repair of the compressor, the shaft 6 can be easily detached from the front housing 4, thereby improving the working conditions.

The above embodiment employs a scroll compressor; however, the type of compressor is not limited to the scroll type. Any compressors for compressing a gas by rotating the shaft 6 may be used.

What is claimed is:

1. A compressor comprising:

a first housing;

a shaft having an end portion which protrudes from the first housing and which is rotated by a driving source;

a compression mechanism provided at the side of the other end portion of the shaft for compressing and discharging a gas which is absorbed into the compression mechanism due to the rotation of the shaft;

a second housing for containing the compression mechanism, the second housing being joined with the first housing; and first and second rolling bearings for rotatably supporting the shaft, wherein the first and second rolling bearings are positioned in an insertion hole which is formed in the first housing and into which the shaft is inserted, and wherein:

the first rolling bearing is a needle bearing for permitting the movement of the shaft in the axial direction of the shaft and is inserted into the first housing from the side where the compression mechanism is to be provided;

the second rolling bearing is a ball bearing for restricting the movement of the shaft in the axial direction of the shaft and is inserted into the first housing from the other side where the driving source is to be provided; and the shaft is inserted into the first housing from the side where the compression mechanism is to be provided, the compressor further comprising:

a seal member provided between the first and second rolling bearings for sealing an area between the insertion hole and the shaft, wherein the seal member is inserted into the insertion hole of the first housing from the side where the compression mechanism is to be provided before the shaft is inserted into the insertion hole, the insertion hole having a uniform diameter opening and seating portion for insertion and seating of the seal member, wherein a protrusion is formed in a circumferential direction on an inner peripheral face of the insertion hole of the first housing;

the seal member is inserted into the insertion hole in a manner such that the seal member is positioned between the protrusion and the compression mechanism;

the second rolling bearing has inner and outer rings, and the position of the second rolling bearing with respect to the first housing in the axial direction of the shaft is determined by making the outer ring contact a side face of the protrusion;

the shaft has a step portion formed at a head portion of the shaft, and the position of the shaft with respect to the second rolling bearing in the axial direction of the shaft is determined by making the step portion contact the inner ring; and the other side face of the protrusion functions as a stopper for restricting the position of the seal member in the axial direction of the first housing.

2. A compressor as claimed in claim 1, which is a scroll compressor.

* * * * *